US006228567B1

(12) United States Patent
Darmon et al.

(10) Patent No.: US 6,228,567 B1
(45) Date of Patent: May 8, 2001

(54) HOMOGENEOUS PHOTOGRAPHIC COLOR DEVELOPING CONCENTRATE

(75) Inventors: Charles M. Darmon, Spencerport; Jean M. Buongiorne, Brockport; Michael J. Haight, Rochester; Paul A. Schwartz, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/544,692

(22) Filed: Apr. 7, 2000

Related U.S. Application Data

(63) Continuation-in-part of application No. 09/132,200, filed on Aug. 11, 1998, now Pat. No. 6,077,651.

(51) Int. Cl.[7] ..... G03C 7/413

(52) U.S. Cl. ..... 430/466; 430/490; 430/492

(58) Field of Search ..... 430/466, 490, 430/492

(56) References Cited

U.S. PATENT DOCUMENTS

| | | | |
|---|---|---|---|
| 3,574,619 | 4/1971 | Surash | 430/466 |
| 4,232,113 | 11/1980 | Marchesano | 430/450 |
| 4,987,060 | 1/1991 | Marchesano | 430/434 |
| 5,273,865 | 12/1993 | Loiacono et al. | 430/490 |
| 5,376,510 | 12/1994 | Parker et al. | 430/466 |
| 5,660,974 | 8/1997 | Marrese et al. | 430/490 |
| 5,837,435 | 11/1998 | Abe | 430/490 |
| 5,891,609 | 4/1999 | Papai | 430/466 |
| 6,017,687 | 1/2000 | Darmon et al. | 430/466 |
| 6,077,651 * | 6/2000 | Darmon et al. | 430/466 |

FOREIGN PATENT DOCUMENTS

| | | |
|---|---|---|
| 0 204 372 A1 | 12/1986 | (EP) . |
| 0 793 141 A2 | 9/1997 | (EP) . |
| 0 800 111 A1 | 10/1997 | (EP) . |
| 0 980 024 | 2/2000 | (EP) . |

OTHER PUBLICATIONS

"Fuji Hunt's New One–Part Rapid Access Developer Is Good For Business And The Environment", PMA 2000, Feb. 3, 2000.

Advertisement for TriPhase ™ RA–RT Developer, from Jan., 1999 issue of "Photographic Processing".

Fotofacts, Feb. 2000, Champion Photochemistry, PMA 2000 Advertisement.

* cited by examiner

*Primary Examiner*—Hoa Van Le
(74) *Attorney, Agent, or Firm*—J. Lanny Tucker

(57) ABSTRACT

A homogeneous color developing concentrate comprises a color developing agent in free base form, an antioxidant for the color developing agent and a water-miscible or water-soluble hydroxy-substituted, straight-chain organic solvent. This concentrate is prepared in a unique manner, namely by combining the noted components and removing the sulfate anions commonly present in color developing agents by precipitation with alkali metal ions. The concentrate can be used to prepare photographic processing concentrates and working strength solutions.

12 Claims, No Drawings

HOMOGENEOUS PHOTOGRAPHIC COLOR DEVELOPING CONCENTRATE

RELATED APPLICATION

This is a Continuation-In-Part Application of U.S. Ser. No. 09/132,200 filed Aug. 11, 1998, now U.S. Pat. No. 6,077,651.

FIELD OF THE INVENTION

The present invention relates to a concentrate useful for making a homogeneous photographic color developing composition. This concentrate is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al) describes conventional color developing compositions that have found considerable commercial success in the photographic industry. Other known color developing compositions are described in U.S. Pat. No. 4,876,174 (Ishikawa et al), U.S. Pat. No. 5,354,646 (Kobayashi et al) and U.S. Pat. No. 5,660,974 (Marrese et al).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and water, a homogeneous color developing composition can usually be obtained for the working strength solution in the processing machine.

There is a desire in the industry to reduce the number of parts used to prepare color developing compositions, and particularly to prepare replenishing solutions. A wide range of compositions are described in the art or commercially available as "ready to use" solutions, concentrates or dry formulations. Liquid concentrates have only to be diluted with water to provide a working strength solution. Dry formulations need only be dissolved in water. For example, EP-A-0 793,141 (Chugai Photo) describes a two-part color developing composition that can be supplied in either solid or liquid form.

It is generally known that the concentrations of various photochemicals used in a photographic processing bath must lie within certain narrow limits in order to provide optimal performance. The most important solvent for such photoprocessing is water. Most inorganic salts can be readily dissolved in water while the organic photochemicals in such processing baths usually have suitable solubility in water at the desired operating concentrations.

However, water is both an asset and a major problem of ready-to-use and some concentrated photographic compositions because of its presence in high quantity. As a result, the costs of manufacturing, transport and storage of such compositions is steadily growing. Normally, the user of photochemical compositions has water available in which individual photochemicals could be mixed or diluted, but this is usually not practical for a number of reasons. The exact composition of the photochemicals is not readily determined by a common user and manufacturers are not likely to readily provide their formulations for such a purpose. Moreover, even if the formulations are known, mixing mistakes may result in poor photoprocessing results.

For these reasons, there is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

The industry has investigated the use of both concentrates and solid mixtures (including powders and tablets). In most cases, concentrates are convenient to use but may have high packaging costs compared to powders. Powders permit high concentration, but not every photochemical composition can be dried into a stable powder. In addition, powders present problems with dust, separate packaging needs and more troublesome metering or mixing procedures. Not every dry formulation is readily dissolved in water.

Another concentrated form known in the art is a chemical paste or slurry, as described for example in EP-A-0 204,372 (Chemco) and EP-A-0 800,111 (Fuji Photo). These formulations have still other disadvantages, namely lack of homogeneity and slow dissolution rate of solid components.

The casual observer might consider that all of the conventional "parts" used to provide color developing compositions might be readily combined to form a single-part homogeneous composition. This is not as easy as one may think. Interactions among and deterioration of photochemicals are magnified in concentrated form, and the resulting action on processed photographic materials may be undesirable because of the resulting poor images.

Some color developing compositions are commercially available in single-part formulation that overcomes some of the noted problems, but because of the presence of precipitates (such as in slurries) or multiple solvent phases, they require vigorous agitation or mixing before use. Such compositions are generally limited to small volumes. In addition, the presence of the precipitates or "sludge" may be unattractive to users. Some users may not have suitable equipment for proper agitation of multi-phase compositions.

Additional small volume, ready to use color developing compositions are described in U.S. Pat. No. 5,273,865 (Loiacono et al). These compositions are said to be free of bromides, hydroxylamines and benzyl alcohol, to include a polyol compound having 4 to 8 hydroxy groups, and to be useful for rapid access processing of photographic elements having high silver bromide emulsions only.

There is a continuing need in the photographic industry for a single-part color developing composition that is homogeneous, concentrated and stable. Such compositions would reduce the cost of shipping and storage of diluted solutions, avoid the need for mixing multiple parts or agitation of multi-phase compositions, and offer the user a more attractive product. This long felt need is met with the concentrates described and claimed in copending and commonly assigned U.S. Ser. No. 09/132,200 filed Aug. 11, 1998.

SUMMARY OF THE INVENTION

This invention provides an advance in the art with a homogeneous color developing concentrate having a pH of 7 or more, and comprising:

a) at least 0.06 mol/l of a color developing agent in free base form, b) at least 0.05 mol/l of an antioxidant for the color developing agent, and c) a photographically inactive water-miscible or water-soluble hydroxy-containing, straight-chain organic solvent for the color developing agent in free base form, the organic solvent having a molecular weight of from about 50 to about 200.

One method of preparing the homogeneous color developing concentrate described above comprises:

A) mixing a color developing agent present as a sulfate salt, an antioxidant for the color developing agent, an alkali metal base to provide alkali metal ions in at least stoichiometric proportion to sulfate ions present in the sulfate salt, and a photographically inactive water-miscible or water-soluble, hydroxy-containing, straight-chain organic solvent, the organic solvent having a molecular weight of from about 50 to about 200, to form a water-insoluble alkali metal sulfate in the solution, and B) removing the water-insoluble alkali metal sulfate from the solution.

The color developing concentrate and method for its preparation offer a number of advantages over the photochemical compositions currently available or known. The concentrate has minimal water, resulting in considerable savings in manufacturing, shipping and storage costs. In addition, the concentrate of this invention and the resulting homogeneous processing composition are free of precipitates, slurries or multiple solvent phases. They do not require vigorous agitation prior to use, and can be immediately used with minimal instruction or possibility of mistake. For example, the processing composition can be used in "automatic replenishing" processors where the processing composition is diluted and used as needed.

It was unexpected to us that formulating the chemicals needed for the concentrate of this invention resulted in minimal loss in chemical stability of any of those chemicals (such as the antioxidant and color developing agent) and less change in pH. This was unexpected because it is well known in the art that several of such chemicals adversely affect each other, and because of that, they were usually separated in multiple parts for shipping and storage. For example, in conventional solutions, the color developing agent is usually kept at acidic pH. We have been able to keep this component at a higher pH and maintain its stability.

The homogeneity noted above had been achieved because of our discovery that the presence of high sulfate ion concentration is detrimental to concentrate stability. The sulfate ion is likely to cause precipitation when attempts are made to reduce the water content and to provide of the desired photochemicals in a photochemical solution. Thus, once we determined the source of the problem, we discovered a way to remove the sulfate ion with a mixing sequence that is an advance in the art. For example, we removed the sulfate ions during a first step of the formulation procedure, providing a substantially clear concentrate that is ready to use.

The sulfate ions are removed early in the formulation of the concentrate by precipitating them in the presence of an alkali metal base and a particular water-soluble or water-miscible hydroxy-containing, straight-chain organic solvent. This solvent has a critical molecular weight of from about 50 to about 200 for effectiveness and solubility. The sulfate precipitate is readily removed before additional photochemicals are added. Preferably, the resulting concentrate is essentially sulfate ion free (meaning less than 0.005 mol/l of sulfate ion).

DETAILED DESCRIPTION OF THE INVENTION

A representative method of preparing the homogeneous color developing concentrate of this invention comprises a sequence of steps:

An aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure,* publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, other salt forms (e.g. phosphates and tosylates) and the free base forms of any of the listed compounds, and others readily apparent to one skilled in the art.

In order to protect the color developing agents from oxidation, one or more antioxidants are generally included in the color developing concentrates. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123,976, (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804, U.S. Pat. No. 4,876,174, U.S. Pat. No. 5,354,646, and U.S. Pat. No. 5,660,974, all noted above, and U.S. Pat. No. 5,646,327 (Burns et al), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the structure I:

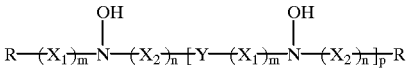

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is $—CR_2(OH)CHR_1—$ and $X_2$ is $—CHR_1CR_2(OH)—$ wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Many of the noted antioxidants (organic or inorganic) are either commercially available or prepared using starting materials and procedures described in the references noted above in describing hydroxylamines.

Buffering agents can be present in the color developing processing compositions to provide or maintain desired alkaline pH. These buffering agents must be soluble in the organic solvent described herein and have a pKa of from about 9 to about 13. Such useful buffering agents include, but are not limited to, carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

The concentrate of this invention generally has a pH of 7 or greater, and preferably from about 7 to about 14 (more preferably from about 8 to about 14). Buffers may or may not be present.

In addition to buffering agents, pH can also be raised or lowered to a desired value using one or more acids or bases. It may be particularly desirable to raise the pH by adding a base, such as a hydroxide (for example sodium hydroxide or potassium hydroxide).

An essential component of the color developing concentrate of this invention is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol, triethylene glycol and polyethylene glycol being most preferred. Of the alcohols, ethanol and benzyl alcohol are most preferred. The most preferred organic solvent is diethylene glycol.

The amounts of water and organic solvent in the color developing concentrate are carefully controlled to achieve all of the desired results and to insure a single phase homogeneous solution. If there is too much water, phase separation may occur. If there is too much organic solvent, the buffering agent and other salts will precipitate.

The color developing concentrate can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with or without lithium, magnesium or other small cations), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure,* noted above]. The amounts of such additives are well known in the art also. Representative color developing concentrates are described below in Example 1.

The following TABLE I shows the general and preferred amounts of essential components of the color developing concentrates. The preferred ranges are listed in parentheses ( ), and all of the ranges are considered to be approximate or "about" in the upper and lower end points.

TABLE I

| COMPONENT | CONCENTRATE CONCENTRATIONS |
|---|---|
| Color developing agent | 0.06–0.8 mol/l (0.1–0.5 mol/l) |
| Antioxidant | 0.05–1.5 mol/l (0.1–1 mol/l) |
| % organic solvent based on total solvents | 20–100% (50–100%) |

The color developing concentrates have utility for making color developing processing compositions that can be used to process an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed, the types of elements being well known in the art (see *Research Disclosure,* noted above). In particular, color developing compositions can be used to process color photographic papers of all types of emulsions including so-called "high chloride" and "low chloride" type emulsions, and so-called tabular grain emulsions as well. The color developer composition can also be used in processing of color reversal and color negative films.

The color developing processing compositions are particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed. The layers of the photographic elements can have any useful binder material or vehicle as it known in the art, including various gelatins and other colloidal materials.

Color development of an imagewise exposed photographic silver halide element is carried out by contacting the element with a color developing processing composition under suitable time and temperature conditions, in suitable processing equipment, to produce the desired developed image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure,* noted above).

The processed photographic elements can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure,* noted above. Included within such teachings in the art is the use of various classes of cyan, yellow and magenta color couplers that can be used with the present invention (including pyrazolone and pyrazolotriazole type magenta dye forming couplers).

Processing can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

Color development is generally followed by a bleaching or bleach/fixing step using a suitable silver bleaching agent. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure,* noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al).

The processing time and temperature used for each processing step are generally those conventionally used in the art. For example, color development is generally carried out at a temperature of from about 20 to about 60° C. The overall color development time can be up to 40 minutes, and preferably from about 75 to about 450 seconds. The shorter overall color development times are desired for processing color photographic papers.

In one embodiment, the color developing concentrate is one chemical formulation in a photographic processing chemical kit that can include one or more other photographic processing compositions (dry or liquid) including, but not limited to, other compositions (or "parts") containing components for color development, a photographic bleaching composition, a photographic bleach/fixing composition, a photographic fixing composition, and a photographic stabilizing or rinsing composition. Such additional compositions can be formulated in concentrated or working strength solutions, or provided in dry form (for example, as a powder or tablet). Other processing compositions that can be included in such kits for either black and white or color photographic processing are reversal compositions, conditioning compositions, prebleach compositions, acidic stop compositions, and others readily apparent to one skilled in the photographic art. The processing kits can also include various processing equipment, metering devices, processing instructions, silver recovery devices and other conventional materials as would be readily apparent to one skilled in the art.

The following examples are provided to illustrate the practice of this invention and not to limit it in any way. Unless otherwise indicated, percentages are by weight.

EXAMPLE 1

Color Paper Color Developing Concentrate and Processing Concentrate

A color developing concentrate of this invention (about 100 ml) was formulated in the following manner:

A solution of sodium hydroxide (50% solution, 7.4 g) was added to a solution of 4-(N-ethyl-N-2-methanesulfonylaminoethyl)-2-methylphenylenediamine sesquisulfate (CD-3, 12.6 g) and diethylhydroxylamine (5.4 g) in water (10 g). Because diethylhydroxylamine is an organic liquid, two phases resulted. With stirring, diethylene glycol (40 g) was then added, and a precipitate of sodium sulfate was observed. This precipitate was filtered out of the solution, washed with 50 g of diethylene glycol and discarded. Thus, the concentration of this invention was essentially free of sulfate ions.

The following components were then added to the concentrate of this invention:

TABLE II

| | |
|---|---|
| Triethanolamine (85% solution) | 4.6 g |
| Substituted triazinylstilbene optical brightener | 1.7 g |
| 1-Hydroxyethylidene-1,1-diphosphonic acid (60% w/w solution, DEQUEST 2010) | 0.11 g |
| and/or | or |
| DEQUEST 2066 diethylenetriaminepenta-phosphonic acid, sodium salt (Solutia Co.) | 8 g |
| Potassium bromide | 0.04 g |
| Potassium carbonate (47% solution) | 63.6 g |

After addition of these components, the mixture was stirred until a homogeneous solution was obtained, filtered to remove a slight haze, and packaged as a color developing processing concentrate useful for photographic processing. This concentrate was also essentially free of all sulfate ions.

EXAMPLES 2 and 3

Alternative Color Paper Color Developing Concentrates and Processing Concentrates Example 1 was repeated except that either ethylene glycol (Example 2) or dipropylene glycol (Example 3) was used in place of diethylene glycol. In both instances, a homogeneous color developing concentrate of this invention was achieved. These concentrates were used to make color developing processing concentrates as described in Example 1.

EXAMPLE 4

Preferred Color Developing Concentrate

A color developing concentrate of this invention was prepared like that shown in Example 1 except diethylhydroxylamine was replaced with N,N'-bis(2,3-dihydroxypropyl)hydroxylamine (5.4 g of 50% solution). The resulting concentrate was homogeneous and free of haze and sulfate ions.

EXAMPLE 5

Preparation of Working Strength Color Developing Composition and Processing of Color Paper A color developing composition useful for photoprocessing was prepared by diluting the color developing processing concentrate prepared in Example 1 about 10 times with water.

This composition was then used for color development in processing imagewise exposed samples of commercially available KODAK EKTACOLOR EDGE 8 Color Papers using the following processing protocol and conditions to obtain acceptable color images:

| | | |
|---|---|---|
| Color Development | 38° C. | 25 seconds |
| Bleach/fixing | 35° C. | 25 seconds |
| Washing (water) | 35° C. | 90 seconds |

The invention has been described in detail with particular reference to preferred embodiments thereof, but it will be understood that variations and modifications can be effected within the spirit and scope of the invention.

We claim:

1. A homogeneous color developing concentrate having a pH of 7 or more and comprising:

a) at least 0.06 mol/l of a color developing agent in free base form, b) at least 0.05 mol/l of an antioxidant for said color developing agent, and c) a water-miscible or water-soluble hydroxy-substituted, straight-chain organic solvent that has a molecular weight of from about 50 to about 200.

2. The concentrate of claim 1 having a pH of from about 7 to about 14.

3. The concentrate of claim 1 wherein said color developing agent is present in an amount of from about 0.06 to about 0.8 mol/l, and said antioxidant is present in an amount of from about 0.05 to about 1.5 mol/l.

4. The concentrate of claim 1 wherein said antioxidant is a hydroxylamine derivative having a solubilizing group.

5. The concentrate of claim 4 wherein said antioxidant is represented by the structure I:

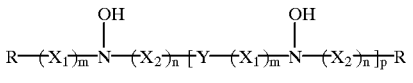

wherein R is hydrogen, an alkyl group, a hydroxyalkyl group, a cycloalkyl group or an aryl group, $R_1$ and $R_2$ are independently hydrogen, hydroxy, an alkyl group, or a hydroxyalkyl group, or $R_1$ and $R_2$ together represent the carbon atoms necessary to complete a 5- to 8-membered carbocyclic ring structure, $X_1$ is —$CR_2(OH)CHR_1$—, $X_2$ is —$CHR_1CR_2(OH)$—, and m, n and p are independently 0 or 1.

6. The concentrate of claim 1 wherein said organic solvent is an aliphatic compound having a molecular weight of from about 100 to about 200, and has from 2 to 10 carbon atoms.

7. The concentrate of claim 6 wherein said solvent is an alcohol or glycol.

8. The concentrate of claim 7 wherein said organic solvent is ethylene glycol, diethylene glycol, triethylene glycol, polyethylene glycol, ethanol or benzyl alcohol.

9. The concentrate of claim 8 wherein said solvent is diethylene glycol.

10. The concentrate of claim 1 wherein said color developing agent is 4-(N-ethyl-N-2-methanesulfonylaminoethyl)-2-methylphenylenediamine sesquisulfate in its free base form.

11. A homogeneous color developing concentrate that is essentially free of sulfate ion, having a pH of from about 8 to about 14 and comprising:

a) from about 0.1 to about 0.5 mol/l of a color developing agent in free base form that is 4-(N-ethyl-N-2-methanesulfonylaminoethyl)-2-methylphenylenediamine sesquisulfate in its free base form, b) from about 0.1 to about 1 mol/l of an antioxidant for said color developing agent, and c) ethylene glycol, diethylene glycol, triethylene glycol, polyethylene glycol, ethanol or benzyl alcohol.

12. The concentrate of claim 11 comprising diethylene glycol.

* * * * *